US009454107B2

(12) United States Patent
Shimizu et al.

(10) Patent No.: US 9,454,107 B2
(45) Date of Patent: Sep. 27, 2016

(54) IMAGE FORMING APPARATUS

(71) Applicants: Yasunobu Shimizu, Kanagawa (JP); Shinya Tanaka, Kanagawa (JP); Hirokazu Ishii, Tokyo (JP); Keigo Nakamura, Kanagawa (JP)

(72) Inventors: Yasunobu Shimizu, Kanagawa (JP); Shinya Tanaka, Kanagawa (JP); Hirokazu Ishii, Tokyo (JP); Keigo Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/918,088

(22) Filed: Jun. 14, 2013

(65) Prior Publication Data

US 2014/0029988 A1 Jan. 30, 2014

(30) Foreign Application Priority Data

Jul. 25, 2012 (JP) ..... 2012-164587
Feb. 15, 2013 (JP) ..... 2013-027540

(51) Int. Cl.
*G03G 15/20* (2006.01)
*G03G 15/16* (2006.01)

(52) U.S. Cl.
CPC ..... *G03G 15/1665* (2013.01); *G03G 15/16* (2013.01); *G03G 15/1675* (2013.01)

(58) Field of Classification Search
CPC ..... G03G 15/1675; G03G 15/1605; G03G 15/0131
USPC ..... 399/314
See application file for complete search history.

(56) References Cited

U.S. PATENT DOCUMENTS

2002/0159801 A1* 10/2002 Nakashima ..... G03G 15/101 399/307
2004/0109705 A1* 6/2004 Watanabe ..... G03G 21/0064 399/129
2004/0165902 A1* 8/2004 Matsuura ..... 399/66
2008/0260401 A1* 10/2008 Shimazaki ..... G03G 15/1675 399/66

(Continued)

FOREIGN PATENT DOCUMENTS

JP 4-086878 3/1992
JP 9-146381 6/1997

(Continued)

OTHER PUBLICATIONS

U.S. Appl. No. 13/785,621, filed May 3, 2013.

(Continued)

*Primary Examiner* — Walter L Lindsay, Jr.
*Assistant Examiner* — Frederick Wenderoth
(74) *Attorney, Agent, or Firm* — Oblon, McClelland, Maier & Neustadt, L.L.P.

(57) ABSTRACT

A novel image forming apparatus includes a photoreceptor to bear an electrostatic latent image on a surface thereof, a developing device to develop the electrostatic latent image into a toner image, an intermediate transfer member onto which the electrostatic latent image is transferred, a primary transfer member to apply a primary transfer bias to the intermediate transfer member to transfer the toner image thereto, a secondary transfer member supplied with a secondary transfer bias to transfer the toner image from the intermediate transfer member onto a recording medium, and a transfer bias power source to selectively apply to the secondary transfer member one of a secondary transfer bias consisting of a direct current (DC) voltage in a DC transfer mode and a secondary transfer bias consisting of a superimposed bias in which an alternating voltage is superimposed on a DC voltage.

29 Claims, 11 Drawing Sheets

(56) References Cited

U.S. PATENT DOCUMENTS

| | | | | |
|---|---|---|---|---|
| 2009/0304403 | A1* | 12/2009 | Inada | 399/44 |
| 2010/0008687 | A1 | 1/2010 | Ishii | |
| 2010/0098446 | A1 | 4/2010 | Ishikawa et al. | |
| 2012/0008991 | A1 | 1/2012 | Shimizu | |
| 2012/0045231 | A1 | 2/2012 | Ogino et al. | |
| 2012/0045237 | A1 | 2/2012 | Aoki et al. | |
| 2012/0045259 | A1 | 2/2012 | Nakamura et al. | |
| 2012/0106998 | A1* | 5/2012 | Ishizumi | G03G 15/161 399/50 |
| 2012/0128380 | A1* | 5/2012 | Hirabayashi | G03G 15/5041 399/49 |
| 2012/0170951 | A1 | 7/2012 | Ishii | |
| 2012/0230715 | A1 | 9/2012 | Ogino et al. | |
| 2012/0237234 | A1 | 9/2012 | Sugimoto et al. | |
| 2012/0237271 | A1 | 9/2012 | Sengoku et al. | |
| 2012/0243892 | A1 | 9/2012 | Nakamura et al. | |
| 2012/0308250 | A1 | 12/2012 | Shimizu et al. | |
| 2012/0315058 | A1* | 12/2012 | Shimizu et al. | 399/66 |
| 2012/0328314 | A1* | 12/2012 | Sugimoto et al. | 399/66 |
| 2012/0328315 | A1 | 12/2012 | Takeuchi et al. | |
| 2012/0328320 | A1 | 12/2012 | Fujita et al. | |
| 2012/0328321 | A1 | 12/2012 | Takeuchi et al. | |
| 2013/0004190 | A1 | 1/2013 | Sengoku et al. | |
| 2013/0011155 | A1 | 1/2013 | Ogiyama et al. | |
| 2013/0016989 | A1 | 1/2013 | Fujita et al. | |
| 2013/0064559 | A1 | 3/2013 | Nakamura et al. | |
| 2013/0089363 | A1 | 4/2013 | Mimbu et al. | |
| 2013/0094870 | A1 | 4/2013 | Shimizu et al. | |
| 2013/0121714 | A1 | 5/2013 | Tanaka et al. | |
| 2013/0136468 | A1 | 5/2013 | Shimizu et al. | |
| 2013/0136477 | A1 | 5/2013 | Ogiyama et al. | |
| 2013/0142531 | A1 | 6/2013 | Sugimoto et al. | |
| 2013/0164011 | A1 | 6/2013 | Nakamura et al. | |

FOREIGN PATENT DOCUMENTS

| | | |
|---|---|---|
| JP | 2006-267486 | 10/2006 |
| JP | 2008-058585 | 3/2008 |

OTHER PUBLICATIONS

U.S. Appl. No. 13/770,500, filed Feb. 19, 2013.
U.S. Appl. No. 13/747,629, filed Jan. 23, 2013.
U.S. Appl. No. 13/739,482, filed Jan. 11, 2013.
U.S. Appl. No. 13/718,395, filed Dec. 18, 2012.
U.S. Appl. No. 13/690,408, filed Nov. 30, 2012.
U.S. Appl. No. 13/893,594, filed May 14, 2013, Tanaka, et al.
U.S. Appl. No. 13/893,594, filed May 14, 2013.

* cited by examiner

IMAGE FORMING APPARATUS

CROSS-REFERENCE TO RELATED APPLICATIONS

This patent application is based on and claims priority pursuant to 35 U.S.C. §119 from Japanese Patent Application Nos. 2012-164587, filed on Jul. 25, 2012, and 2013-027540, filed on Feb. 15, 2013, both in the Japan Patent Office, which are hereby incorporated by reference herein in their entirety.

BACKGROUND

1. Technical Field

Exemplary aspects of the present disclosure generally relate to an image forming apparatus, and more particularly, to a copy machine, a printer, a facsimile machine, or a multi-functional system including at least two of these functions thereof.

2. Related Art

Related-art image forming apparatuses, such as copiers, facsimile machines, printers, or multi-functional systems having at least one of copying, printing, scanning, and facsimile capabilities, typically form an image on a recording medium according to image data. Thus, for example, a charger uniformly charges a surface of a photoreceptor (which may, for example, be a photoconductive drum); an optical writer projects a light beam onto the charged surface of the photoreceptor according to image data; a developing device supplies toner to the electrostatic latent image formed on the photoreceptor to render the electrostatic latent image visible as a toner image; the toner image is directly transferred from the photoreceptor onto a recording medium or is indirectly transferred from the photoreceptor onto a recording medium via an intermediate transfer member using a transfer device; a cleaning device then cleans the surface of the photoreceptor after the toner image is transferred from the photoreceptor onto the recording medium; finally, a fixing device applies heat and pressure to the recording medium bearing the unfixed toner image to fix the unfixed toner image on the recording medium, thus forming the image on the recording medium.

Conventionally, in such electrophotographic image forming apparatuses, constant current control of a direct current (DC) transfer bias that is applied to a transfer device using a DC power source is widely employed.

In recent years, however, a variety of recording media such as paper having a leather-like texture and Japanese paper known as "Washi" have come on the market. Such recording medium have a coarse surface due to fabrication such as embossing. However, toner does not transfer well to such recording medium, in particular recessed portions of the surface, causing gaps in an output image.

It is known that superimposing an alternating current (AC) voltage onto a DC voltage enhances toner transfer rate and prevents image defects. In such a configuration, changing transfer modes between a DC transfer mode and a DC-AC superimposed transfer mode (hereinafter referred to as superimposed transfer mode), in accordance with the type of recording medium leads to enhanced transferability of toner regardless of the type of recording medium.

In such a configuration, when transferring toner by superimposing the AC voltage onto the DC voltage, an AC component affects transfer of toner to the recessed portion of the recording medium and a DC component affects transfer of toner to the projecting portion. Therefore, there is a need to increase the strength of the DC bias to the transfer side according to the resistivity of the recording medium and the depth of the recessed portions in the surface of the recording medium (Refer to Voff in FIGS. 1(*a*) and (*b*)). At the same time, it is necessary that the polarity of the AC component opposite the polarity of the AC voltage at the toner transfer side that affects transfer of toner to the recessed portions remains constant (Refer to Vr in FIGS. 1(*a*) and (*b*)). Thus, in turn, there is a need to increase the peak-to-peak voltage (Refer to Vpp in FIGS. 1(*a*) and (*b*)) of the AC voltage. Accordingly, the polarity of the AC voltage at the toner transfer side (Refer to Vt in FIGS. 1(*a*) and (*b*)) increases. When a certain voltage is exceeded an electric discharge occurs, causing image degradation such as little or no settling of toner in the recessed portions and discharge images (so called white dot images) on the projecting portions.

Furthermore, it has been found that this electric discharge occurs because toner charge of the toner image before secondary transfer of the toner image is the same in both the DC transfer mode and the superimposed transfer mode, and for that reason the toner charge in the superimposed transfer mode is excessive.

SUMMARY

In view of the foregoing, in an aspect of this disclosure, there is provided a novel image forming apparatus including a photoreceptor to bear an electrostatic latent image on a surface thereof, a developing device to develop the electrostatic latent image into a toner image, an intermediate transfer member onto which the electrostatic latent image is transferred, a primary transfer member to apply a primary transfer bias to the intermediate transfer member to transfer the toner image thereto, a secondary transfer member supplied with a secondary transfer bias to transfer the toner image from the intermediate transfer member onto a recording medium, and a transfer bias power source to selectively apply to the secondary transfer member one of a secondary transfer bias consisting of a direct current (DC) voltage in a DC transfer mode and a secondary transfer bias consisting of a superimposed bias in which an alternating current (AC) voltage is superimposed on a DC voltage and having a waveform in which a polarity alternates between a transfer polarity for transferring the toner image onto the recording medium and a polarity opposite the transfer polarity in a superimposed transfer mode. An absolute value of a DC component of the secondary transfer bias in the superimposed transfer mode is smaller than a DC component of the secondary transfer bias in the DC transfer mode under same environmental conditions, using same recording media, and with same toner images as the superimposed transfer mode.

The aforementioned and other aspects, features and advantages would be more fully apparent from the following detailed description of illustrative embodiments, the accompanying drawings and the associated claims.

DETAILED DESCRIPTION

Figure 1:
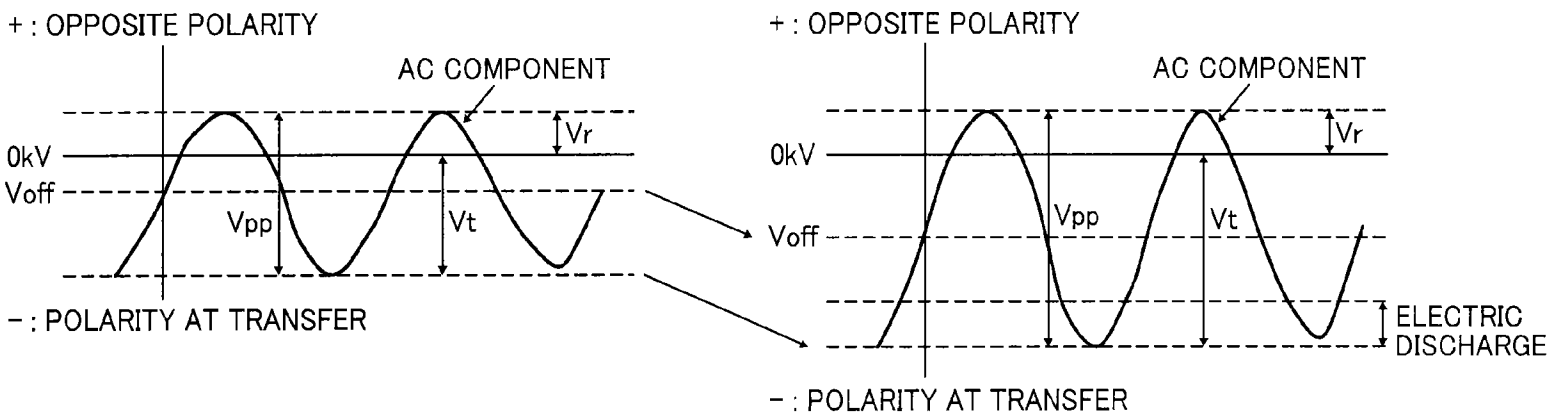
FIG. 1 RELATED ART
FIG. 1 is a waveform diagram illustrating a change of waveform of a conventional transfer bias.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

A description is given below, with reference to FIG. 1 through FIG. 16 of embodiments of the present disclosure.

The following is an image forming apparatus employing an intermediate transfer method as an example of an embodiment of the present disclosure.

Figure 2:
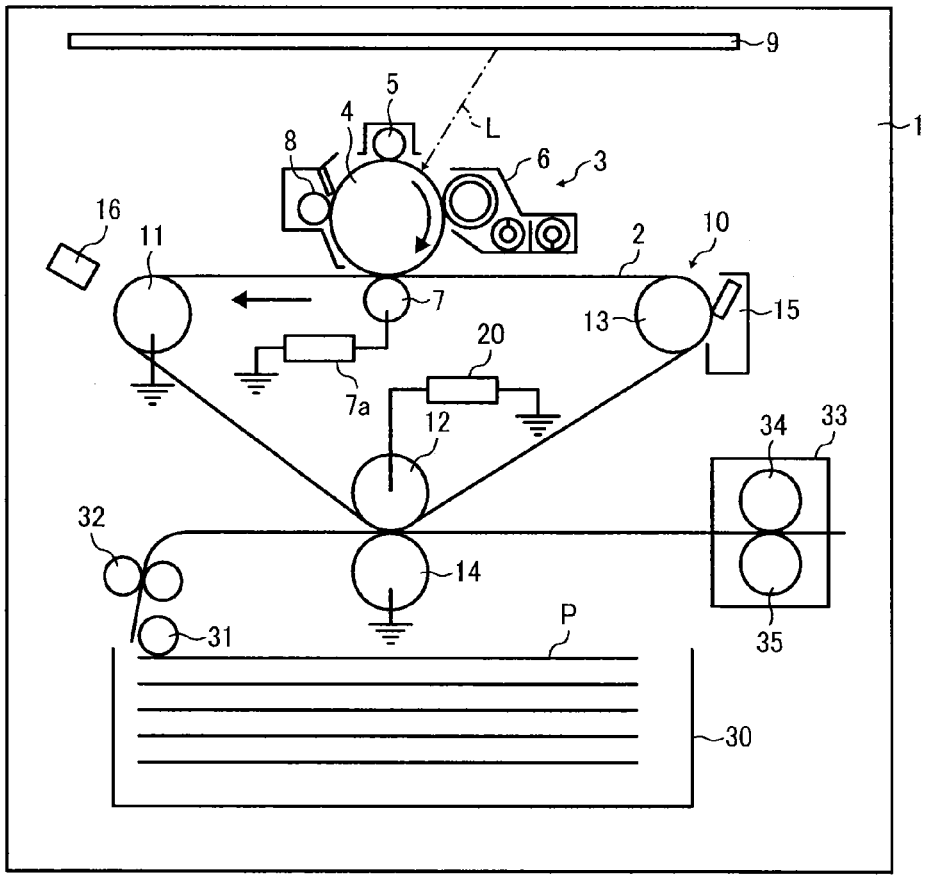
FIG. 2 is a cross-sectional diagram of a printer as an example of an image forming apparatus according to an aspect of the present disclosure.

FIG. 2 is a schematic diagram illustrating an overview of a printer as an example of an image forming apparatus 1 according to an illustrative embodiment of an aspect of the present disclosure. The image forming apparatus 1 includes a belt formed into an endless loop as an intermediate transfer member shown as intermediate transfer belt 2. Disposed above and along the intermediate transfer belt 2 is an image forming unit 3 for forming a single color toner image such as black (K).

Figure 3:
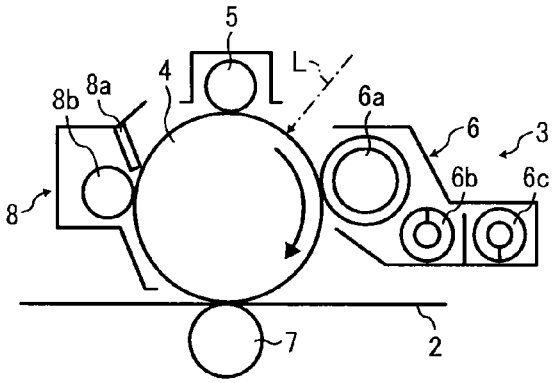
FIG. 3 is an enlarged cross-sectional diagram of an image forming unit employed in the image forming apparatus of FIG. 2.

FIG. 3 is an enlarged schematic diagram of the image forming unit 3. The image forming unit 3 includes a drum-shaped photoreceptor 4, a charging roller 5 as a charging device for charging the surface of photoreceptor 4, a developing device 6 that makes visible a latent image on photoreceptor 4, a primary transfer roller 7 serving as a primary transfer member for transferring a toner image from the photoreceptor 4 to the intermediate transfer belt 2, and a cleaning device 8 for cleaning the surface of the photoreceptor 4. In the present illustrative embodiment, the image forming unit 3 is removably installable in the image forming apparatus 1.

The photoreceptor 4 of the present illustrative embodiment has a drum form with an external diameter of 60 mm and has an organic photoreceptor layer formed around a core that is rotated clockwise as shown in FIG. 3 by a driving device. The charging roller 5 charges the surface of the photoreceptor 4 uniformly by contacting or by bringing into close proximity the charging roller 5 that has been supplied with a charging bias, to the photoreceptor 4 and generating a discharge between the charging roller 5 and the photoreceptor 4. In the present illustrative embodiment, the uniform charging polarity is negative, the same as the normal charge polarity of toner. The employed charging bias is that of an AC voltage superimposed on a DC voltage. Alternatively, a charging device may be used in place of the charging roller 5 serving as a charging device.

In the developing device 6, a two component developer including a toner and a carrier is accommodated. Included within is a developer sleeve 6*a* as a developer carrier and two screw members 6*b* and 6*c* serving as a mixing member for mixing and conveying the developer. Alternatively, a single component developer may be used for a developing device.

The cleaning device 8 includes a cleaning blade 8*a* and a cleaning brush 8*b*. The cleaning blade 8*a* is disposed counter to the direction of the rotation of the photoreceptor 4 and comes into contact with the photoreceptor 4. The cleaning brush 8*b* comes into contact with the photoreceptor 4 and rotates counter to the photoreceptor 4. Both clean residual toner from the surface of the photoreceptor 4.

Returning to FIG. 2, disposed above the image forming unit 3 is an optical writing unit 9 serving as a latent image writing device. The optical writing unit 9, based upon image information sent from an external device such as a personal computer, scans optically the surface of the photoreceptor 4 with a laser light L emitted from a laser diode. Thereby forming an electrostatic latent image on the surface of the photoreceptor 4. More specifically, areas on the uniformly charged surface of the photoreceptor 4 that have been irradiated with the laser light have an attenuated electric potential. As a result, the electric potential of laser irradiated areas is lower than that of other non-irradiated areas (uniformly charged surface) thereby forming an electrostatic latent image. The optical writing unit 9 includes a light source that emits the laser light L. The emitted laser light L is polarized by a polygon mirror that is rotated by a polygon motor not shown in FIG. 2. The polarized laser light L irradiates the photoreceptor 4 via multiple optical lenses and mirrors in the main scanning direction. Alternatively, employing a method of optical writing with an LED light emitted from multiple LEDs in an LED array may be used.

Disposed below the image forming unit 3 is a transfer unit 10, serving as a transfer device that moves in a counter clockwise direction as shown in FIG. 2 while holding taut the intermediate transfer belt 2 formed into an endless loop. The transfer unit 10 includes a drive roller 11, a secondary transfer back surface roller 12, a cleaning backup roller 13, the primary transfer roller 7, a nip forming roller 14, a belt cleaning device 15, and an electric potential sensor 16.

The intermediate transfer belt 2 is held taut by the drive roller 11, the secondary transfer back surface roller 12, the cleaning backup roller 13, and the primary transfer roller 7 disposed inside the loop belt. The intermediate transfer belt 2 is moved in an endless loop action by the rotation of the drive roller 11 driven by a driving device in a counter clockwise direction as shown in FIG. 2. The intermediate transfer belt 2 has a thickness in a range from approximately 20 μm to approximately 200 μm, preferably approximately 60 μm.

The volume resistivity of the intermediate transfer belt 2 is in a range from approximately 6.0 log Ωcm to approximately 13.0 log Ωcm, preferably in a range from approximately 7.5 log Ωcm to approximately 12.5 log Ωcm. The volume resistivity of approximately 9.0 log Ωcm is preferable (volume resistivity measurements are conducted with Mitsubishi Chemical Corporation, HIRESTA UP MCP HT45 with a HRS probe, at voltage 100V for 10 sec.). For material thereof, a single layer or multiple layers of, including but not limited to, polyimide (PI), polyvinylidene fluoride (PVDF), ethylene tetrafluoroethylene (ETFE), and polycarbonate (PC) may be used. Depending upon the need, the surface of the belt may be coated with a separation layer.

Material employed for coating thereof is fluorine resins, including but not limited to ethylene tetrafluoroethylene (ETFE), polytetrafluoroethylene (PTFE), polyvinylidene fluoride (PVDF), perfluoroalkoxy fluorocarbon polymer (PFA), fluorinated ethylene propylene (FEP), and polyvinyl fluoride (PVF).

Methods for molding the belt include cast molding and centrifuge casting. Depending upon the need, grinding the surface of the belt may be conducted. The belt (belt formed into a loop) may have a three-layer structure including a base layer, an elastic layer, and a coating layer. In a case in which the belt has a three-layer structure, the base layer is, for example, a fluorine resin with a small degree of stretching or a combination of a rubber material with a large degree of stretching and a material with a small degree of stretching such as canvas. The elastic layer is, for example, a fluorine rubber or an acrylonitrile-butadiene rubber that is formed on the base layer. The coating layer is, for example, a fluorine resin coated on the surface of the elastic layer. Resistivity is adjusted with dispersing conductive material such as carbon black in the belt.

The intermediate transfer belt 2 that moves in an endless loop action is interposed between the primary transfer roller 7 and the photoreceptor 4. A primary transfer nip is formed between the contact of the surface of the intermediate transfer belt 2 and the photoreceptor 4. A primary transfer bias is applied to the primary transfer roller 7 by a primary transfer bias power source 7*a*. Accordingly, a transfer electric field is formed between a toner image on the photoreceptor 4 and the primary transfer roller 7, and the toner image is primarily transferred from the photoreceptor 4 onto the intermediate transfer belt 2 by the transfer electric field and nip pressure.

The primary transfer roller 7 is an elastic roller formed of a metal core on which a conductive sponge layer is fixed. In the present illustrative embodiment, the external diameter is approximately 16 mm. The diameter of the metal core is approximately 10 mm. The volume resistivity is the average of measured resistivity of one rotation at the following conditions.

Measurement method: Rotation measurement
Weight: 5N/one side
Applied bias: 1 KV to the transfer roller shaft
Measurement time: 1 minute The calculated resistivity R of the sponge layer by Ohm's law (R=V/I) is from approximately 6.0 log Ω to approximately 9.0 log Ω, preferably, approximately 7.5 log Ω.

A constant current controlled primary transfer bias is applied to the primary transfer roller 7 as described above. Alternatively, a transfer charger or a transfer brush may be employed for the primary transfer instead of the transfer roller described above.

The nip forming roller 14 of the transfer unit 10 is disposed outside the loop formed by the intermediate transfer belt 2. Interposed between the nip forming roller 14 and the secondary transfer back surface roller 12 is the intermediate transfer belt 2. Accordingly, a secondary transfer nip is formed at the contact between the peripheral surface or the image bearing surface of the intermediate transfer belt 2 and the nip forming roller 14. Whereas the nip forming roller 14 is grounded, by contrast a secondary transfer bias is applied to the secondary transfer back surface roller 12 by a secondary transfer bias power source 20. Accordingly, a secondary transfer electric field is formed between the secondary transfer back surface roller 12 and the nip forming roller 14 so that the toner moves electrostatically from the secondary transfer back surface roller 12 side to the nip forming roller 14 side.

A sheet cassette 30 storing a stack of recording media P is disposed below the transfer unit 10. A sheet feed roller 31 contacts the topmost recording medium P stored in the sheet cassette 30. Accordingly, by rotating the sheet feed roller 31 at a predetermined timing, the top most recording medium P is fed to a sheet passage. A pair of timing rollers 32 that adjusts feed timing is disposed before the secondary transfer nip of the sheet passage. The pair of timing rollers 32 stops rotating after the recording medium P is fed from the sheet cassette 30 and is interposed between the pair of timing rollers 32. The pair of timing rollers 32 starts to rotate again to feed the recording medium P to the secondary transfer nip in an appropriate timing such that the recording medium P is aligned with a toner image formed on the intermediate transfer belt 2 in the secondary transfer nip. In the secondary transfer nip, the recording medium P presses against the toner image on the intermediate transfer belt 2 and the image is transferred secondarily onto the recording medium P due to the secondary transfer electric field and the nip pressure applied thereto. After the toner image is formed on the recording medium P and passes through the secondary transfer nip, the recording medium P separates from the nip forming roller 14 and the intermediate transfer belt 2 due to the curvature of the nip forming roller 14.

The secondary transfer back surface roller 12 is formed of a metal core of stainless steel or aluminum with a resistivity layer. The resistivity layer is of a polycarbonate, a fluorine rubber, or a silicon rubber with conductive materials such as carbon or a metal complex dispersed therein, or NBR or EPDM rubber, or a copolymerized NBR/ECO rubber, or a semi-conductive polyurethane rubber. The volume resistivity is approximately 6.0 log Ω, preferably, in a range from approximately 7.0 log Ω to approximately 9.0 log Ω. A foam type with a hardness in a range from 20 degrees to 50 degrees and a rubber type with a hardness in a range from 30 degrees to 60 degrees may be used. A sponge type is preferred so that the secondary transfer back surface roller 12 can contact more reliably the nip forming roller 14 via the intermediate transfer belt 2 even with a small contact pressure between the intermediate transfer belt 2 and the secondary transfer back surface roller 12. Since improper transfer of toner occurs in character images and thin lines more easily with a high contact pressure, the sponge type is preferred.

The nip forming roller 14 is formed of a stainless steel or aluminum metal core with layers including a resistivity layer of conductive rubber and a surface layer. In the present illustrative embodiment, the external diameter of the roller is approximately 20 mm and the metal core is formed of stainless steel and has a diameter of approximately 16 mm. The resistivity layer is a copolymerized NBR/ECO with a hardness in a range from approximately 40 degrees to 60 degrees (JIS-A). The surface layer is an urethane elastomer comprising fluorine and has a preferred thickness in a range from 8 μm to 24 μm. The surface layer of a roller is often fabricated with a painting process. Thus, a roller with a surface layer with a thickness of under 8 μm results in having a large resistivity unevenness due to unevenness of paint application that in turn may lead to an unfavorable leak at a low resistivity section. Also, there is a higher possibility of a crease forming on the surface of the roller, leading to cracks in the surface layer. If the thickness of the surface layer exceeds 24 μm, the resistivity becomes high. In a case of high volume resistivity, when a constant current is applied to the metal core of the secondary transfer back surface roller 12, there is a possibility of an increase in voltage resulting in electric current below target current strength due to exceeding a voltage variable range of a constant current power source. In a case in which the voltage variable range is sufficiently high, there is a possibility of the metal core of the secondary transfer back surface roller 12 or voltage pathway to the metal core of the secondary transfer back surface roller 12 from the constant current power source becoming high voltage resulting in a higher possibility of leaks. Also, if the thickness of surface layer of the nip forming roller 14 exceeds 24 μm, the hardness increases and there arises an issue of contact between the recording medium (such as paper) and the intermediate transfer belt becoming unfavorable. The surface resistivity of the nip forming roller 14 is equal to or above 106.5Ω and the volume resistivity of the surface layer of the nip forming roller 14 is equal to or above 10.0 log Ωcm, preferably, equal to or above 12.0 log Ωcm.

In the present illustrative embodiment, the nip forming roller 14 is a type with a surface layer, although a type with only a resistivity layer on the metal core may be used. Alternatively, a foam type roller with no surface layer may be used for the nip forming roller 14. In this case, the volume resistivity of the nip forming roller is in a range from approximately 6.0 log Ω to approximately 8.0 log Ω, preferably, in a range from approximately 7.0 log Ω to approximately 8.0 log Ω.

Accordingly, a foam type, a rubber type, or a metal roller such as SUS may be used for the secondary transfer back surface roller 12. It is preferable that the volume resistivity be equal to or below 6.0 log Ω that is lower than the nip forming roller 14. The volume resistivity measurements of the nip forming roller 14 and the secondary transfer back surface roller 12 are taken with the same method as that for the primary transfer roller 7.

The electric potential sensor 16 is disposed on the outside of the loop formed by the intermediate transfer belt 2 opposite the drive roller 11 that is grounded. More specifically, the electric potential sensor 16 faces a portion of the intermediate transfer belt 2 surrounding the drive roller 11 across a gap of approximately 4 mm. The surface potential of the toner image primarily transferred onto the intermediate transfer belt 2 is measured when the toner image comes to the position opposite the electric potential sensor 16. In the present illustrative embodiment, an EFS-22D manufactured by TDK Corp. is employed as the electric potential sensor 16.

Also, the electric potential sensor 16 may be used as a toner image detection sensor. A toner image detection sensor is an optical sensor of a type including a light emitting element and two light receiving elements. By converting a received output into the amount of adhesion, the amount of adhesion of the toner image primarily transferred onto the intermediate transfer belt 2 is detected.

A fixing device 33 fixes the transferred image onto the recording medium P when the recording medium P goes through the secondary transfer nip. The fixing device 33 includes a fixing roller 34 with a halogen lamp as a heat source and a pressing roller 35 that presses against the fixing roller 34 at a predetermined pressure while rotating to form a fixing nip between the fixing roller 34 and the pressing roller 35. The recording medium P bearing an unfixed toner image on its surface is conveyed to the fixing device 33 and is interposed in the fixing nip in an orientation in which the face of the toner image contacts the fixing roller 34. Under heat and pressure, the toner of the toner image is softened and fixed onto the recording medium P. The recording medium P discharged from the fixing device 33 is discharged from the image forming apparatus 1 via the sheet passage after fixation.

Figure 4A:
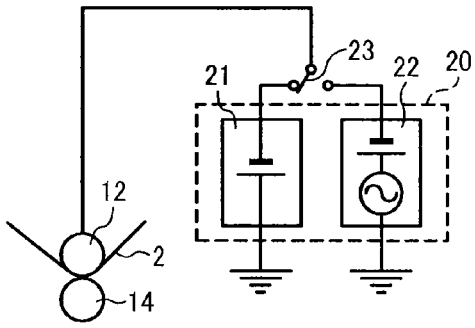
FIG. 4A is a schematic diagram illustrating a secondary transfer bias power source and a secondary transfer member when applying a DC bias thereto according to an aspect of the present disclosure.
Figure 4B:
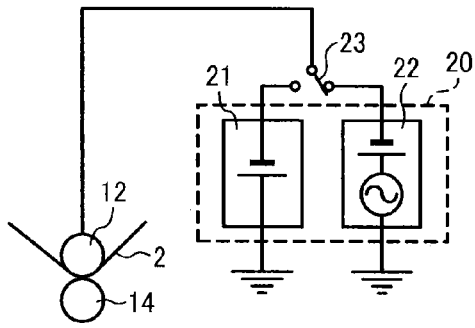
FIG. 4B is a schematic diagram illustrating the secondary transfer bias power source and the secondary transfer member when applying a superimposed bias thereto according to an aspect of the present disclosure.

FIG. 4A and FIG. 4B are schematic diagrams illustrating the application of a bias voltage to a secondary transfer member (in the present illustrative embodiment, the secondary transfer back surface roller 12) while switching between a DC voltage (hereinafter referred to as DC bias) and an AC voltage superimposed on a DC voltage (hereinafter referred to as superimposed bias). As shown in FIGS. 4A and 4B, the secondary transfer bias power source 20 serving as a secondary transfer bias output device of the image forming apparatus 1 of the present illustrative embodiment outputs a secondary transfer bias and includes a DC power source 21 that outputs a DC component and a superimposing power source 22 that is an AC power source which outputs an AC component superimposed on a DC component. The DC bias or the superimposed bias can be outputted as the secondary transfer bias.

Figure 6:
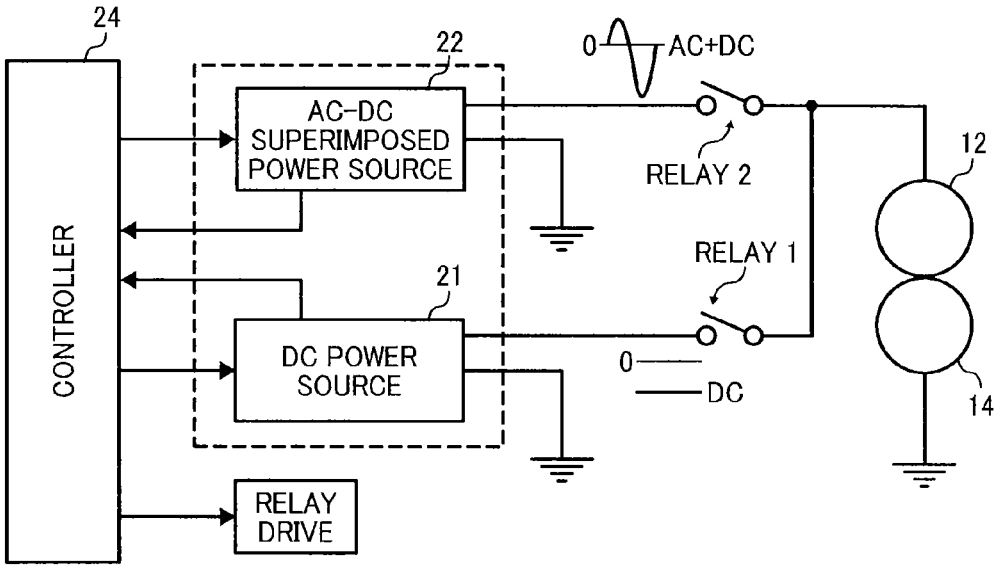
FIG. 6 is a circuit diagram of a configuration of switching of the secondary transfer bias implemented by a relay when switching modes.

FIG. 4A illustrates an application of the DC bias from the DC power source 21 and FIG. 4B illustrates an application of the superimposed bias from the AC power source 22. FIG. 4A and FIG. 4B illustrate a conceptualization of the switching of the DC power source 21 and the AC power source 22. It is to be noted that as shown in FIG. 6, the present illustrative embodiment has a structure in which two relays, relay 1 and relay 2, are employed for switching. As shown in FIG. 6, a controller 24 controls the DC power source 21, the AC power source 22, and a relay drive.

Figure 5:
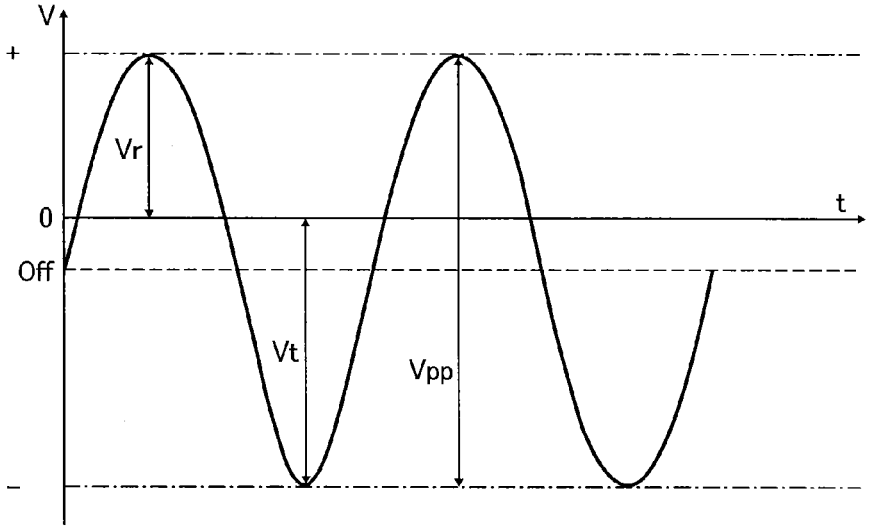
FIG. 5 is a waveform diagram illustrating an example of a waveform of a secondary transfer bias (superimposed bias) output from an AC power source according to an aspect of the present disclosure.

FIG. 5 is a waveform diagram showing an example of a waveform of a superimposed bias outputted from the AC power source 22. In FIG. 5, an offset voltage Voff indicated as Off is the value of the DC component of the superimposed bias. A peak-to-peak voltage Vpp is a peak-to-peak voltage of the AC component of the superimposed bias. The superimposed bias is the offset voltage Voff and the peak-to-peak voltage superimposed, and its time-averaged value (Vave) is the same value as the offset voltage Voff. As illustrated, the superimposed bias has a sinusoidal waveform with a peak value on the positive side and a peak value on the negative side. Of the two peak values, Vt indicates the peak value for moving (transferring) the toner from the belt side to the recording medium side in the secondary transfer nip (in the present illustrative embodiment, the negative side) and Vr indicates the peak value for returning the toner from the recording medium side to the belt side (in the present illustrative embodiment, the positive side). By applying a superimposed bias including a DC component to make the offset voltage Voff that is the time-averaged value have the same polarity as that of the toner (in the present illustrative embodiment, it is negative), the toner can be moved back and forth, or from the belt side to the recording medium side and onto the recording medium. According to the present illustrative embodiment, an AC voltage having a sinusoidal waveform is employed. Alternatively, one with a rectangular form may be employed as well.

Figure 7:
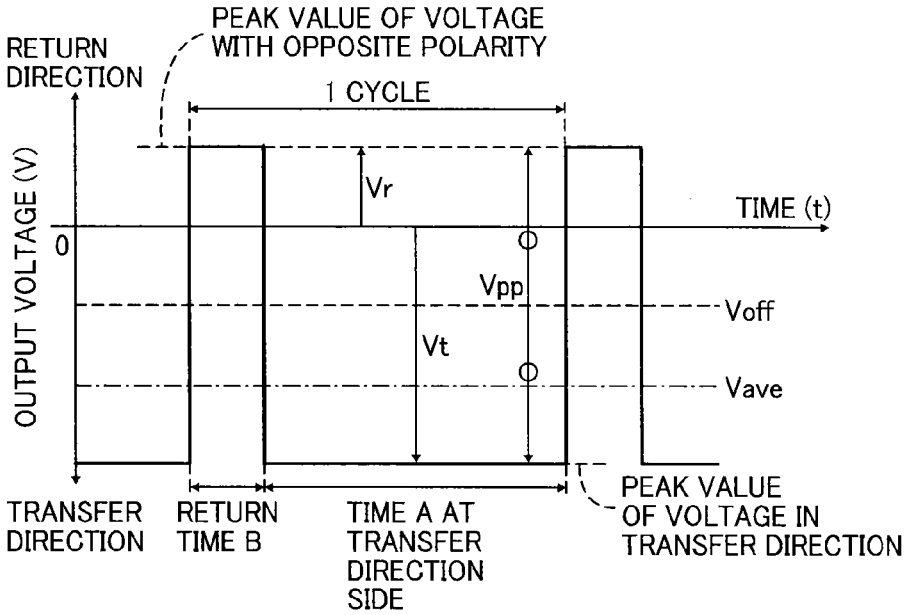
FIG. 7 is a waveform illustrating an example of a low duty waveform.

Also, as shown in FIG. 7, a time A that is the move time of the toner of the AC component moving from the belt side to the recording medium side (in the present illustrative embodiment, the negative side) and a time B that is the return time of the toner moving from the recording medium side to the belt side (in the present illustrative embodiment, the positive side) may be set to differing lengths.

In the present illustrative embodiment, by making the time A longer than the time B, the time-averaged value (Vave) of the AC component of the superimposed bias is set to the polarity of the transfer direction of the transfer of the toner image from the belt side to the recording medium side. Due to this, the AC component of the superimposed bias is, compared to the DC component (Voff) of the superimposed bias, set towards the transfer direction.

When using a recording medium such as "Washi" or embossed paper with a coarse surface, by applying the superimposed bias as described above, and moving the toner from the belt side to the recording medium side and onto the recording medium, transferability to recessed portions increases, transfer rate is enhanced, and image defects such as toner voids are prevented. By contrast, when using a recording medium such as plain paper with a relatively smooth surface, by applying a secondary transfer bias of only the DC component, a satisfactory transferability is attained.

The present illustrative embodiment has a structure that includes a DC transfer mode that transfers images by applying a DC bias and a superimposed transfer mode that transfers images by applying a superimposed bias, an AC superimposed on a DC, as the secondary transfer bias. Accordingly, the transfer modes can be switched. By switching between the transfer modes, the DC transfer mode or the superimposed transfer mode, according to the recording medium that will be fed, good image transfer may be attained for either a recording medium with a coarse surface or a recording medium with a relatively smooth surface. The switching of the transfer mode may be set so that the mode automatically switches according to the type of recording medium or alternatively set so that the user may specify the transfer mode. The setting of the transfer mode may be set from the control panel on the image forming apparatus 1.

Figure 8:
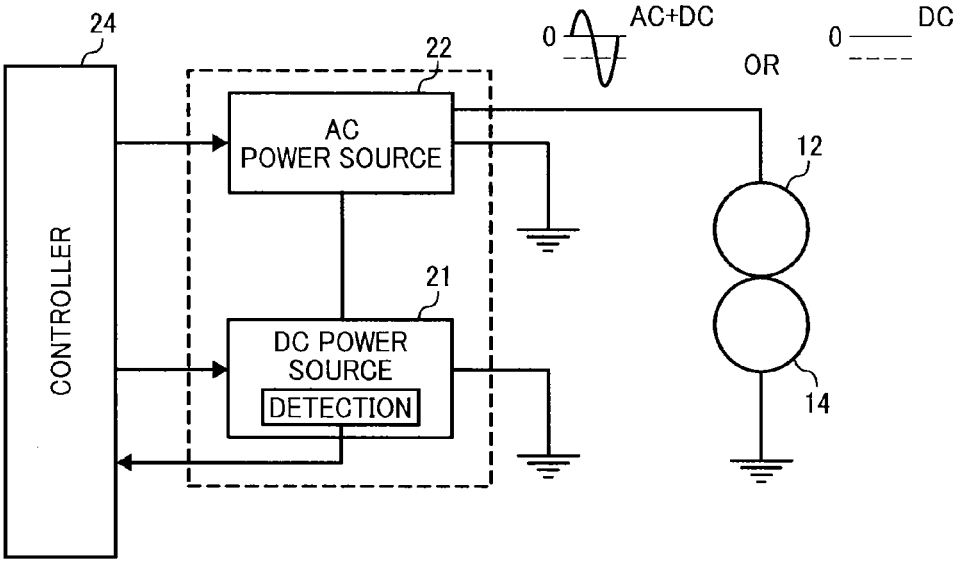
FIG. 8 is a circuit diagram illustrating another example of the configuration of switching of the secondary transfer bias when switching modes.

Also, the present illustrative embodiment includes two power sources, a DC power source and a power source of an AC superimposed on a DC, that is switched with a relay. Alternatively, as shown in FIG. 8, disposing a DC power source 21 and an AC power source 22 and having a method in which the controller 24 switches the DC transfer mode and the superimposed transfer mode according to the presence or absence of output of the AC power source may be employed.

Furthermore, though the secondary transfer bias is applied to the secondary transfer back surface roller 12, a method of applying both the DC and AC to the nip forming roller 14 or applying DC and AC independently to different rollers may be employed.

Next, a description is provided of an embodiment of an image forming apparatus of the present disclosure in which the generation of a discharge image is prevented and good transferability is attained.

It is to be noted that in low temperature and low humidity environments the absolute value of the toner charge is high, and in high temperature and high humidity environments the absolute value of the toner charge is low. Accordingly, it is known to adjust the primary transfer bias, the secondary transfer bias, and various image creating condition settings according to environment conditions. Also, it is known to adjust the primary transfer bias, the secondary transfer bias, and various image creating condition settings according to the thickness of the recording medium, the size of the recording medium, and the image area ratio setting.

One aspect of the present illustrative embodiment is the difference between the superimposed transfer mode and the DC transfer mode under same environmental conditions, using same recording media, and with same toner images. Therefore, the description of the present illustrative embodiment assumes same environmental conditions, using same recording media, and with same toner images.

Also, it is to be noted that in the present illustrative embodiment a negative charged toner is used. The toner is transferred by applying a positive polarity bias for the primary transfer and a negative polarity bias for the secondary transfer.

Embodiment 1

Figure 9:
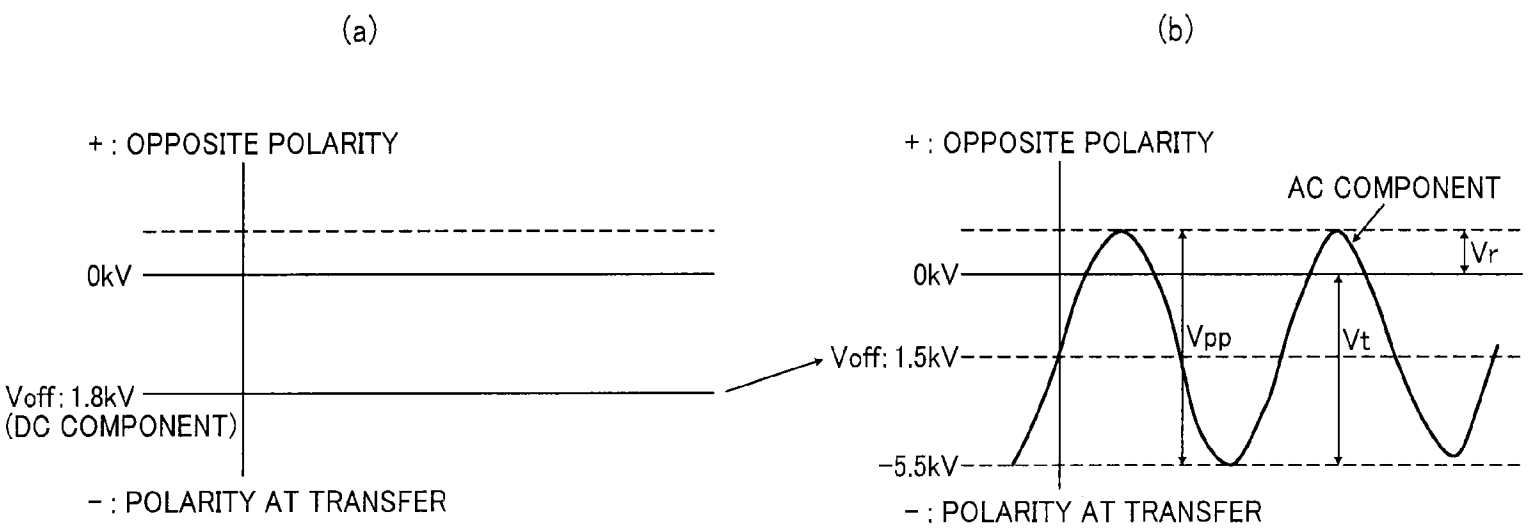
FIG. 9 is a waveform diagram illustrating waveforms of the secondary transfer bias in a DC transfer mode and a superimposed transfer mode of EMBODIMENT 1 and EMBODIMENT 2.

In the following, the setting of the secondary transfer bias in EMBODIMENT 1 is described with reference to FIG. 9 and Table 1.

TABLE 1

| | Secondary transfer current (μA) | Secondary transfer voltage (kVpp) |
|---|---|---|
| DC transfer mode | −40 | — |
| Superimposed transfer mode | −32 | 8 |

In the DC transfer mode, the constant current control of a secondary transfer current is −40 μA. By contrast, in the superimposed transfer mode, the secondary transfer current is −32 μA and the secondary transfer voltage is a sinusoidal wave of 8 kVpp. The secondary transfer bias of each mode include a DC component, but the DC component of the secondary transfer bias in the superimposed transfer mode has a smaller absolute value than the secondary transfer bias in the DC transfer mode. Thus, as shown in the waveform of the secondary transfer bias in FIG. 9(*b*), the absolute value of the DC component, Voff, may be made smaller. As a result, the AC voltage Vpp shown in FIG. 9(*b*), may be made smaller compared to a conventional example shown in Table 7 described hereinafter. Accordingly, image degradation such as discharge images does not occur in the superimposed transfer mode, and good transferability in either the DC transfer mode or the superimposed transfer mode is attained.

It is to be noted that the secondary transfer bias is constant current controlled in the present illustrative embodiment. Alternatively, the secondary transfer bias may be constant voltage controlled. For example, as shown in Table 2, by making the absolute value of the DC voltage in the superimposed transfer mode smaller than the DC voltage in the DC transfer mode, the same result described above may be attained.

TABLE 2

| | Secondary transfer voltage (kV) | Secondary transfer voltage (kVpp) |
|---|---|---|
| DC transfer mode | −1.8 | — |
| Superimposed transfer mode | −1.5 | 8 |

Embodiment 2

EMBODIMENT 2 is an image forming apparatus with the structure described in EMBODIMENT 1 except for the difference in toner charge of the toner image before secondary transfer of the toner image (hereinafter referred to as toner charge before secondary transfer). Table 3 and FIG. 9 are used for the description.

TABLE 3

| | Primary transfer current (μA) | Toner charge before secondary transfer (μC/g) | Secondary transfer current (μA) | Secondary transfer voltage (kVpp) |
|---|---|---|---|---|
| DC transfer mode | 33 | −32 | −40 | — |
| Superimposed transfer mode | 30.5 | −30 | −32 | 8 |

Table 3 illustrates the set value and the toner charge before secondary transfer in the present illustrative embodiment. In the DC transfer mode, the primary transfer current is a constant current controlled 33 μA, the secondary transfer current is a constant current controlled −40 μA, and the toner charge before secondary transfer is −32 μC/g. By contrast, in the superimposed transfer mode, the primary transfer current is a constant current controlled 30.5 μA, the secondary transfer current is a constant current controlled −32 μA, and by making the secondary transfer voltage a sinusoidal wave of 8 kVpp, the toner charge before secondary transfer is −30 μC/g. As a result, the toner charge before secondary transfer has a smaller absolute value in the superimposed transfer mode than in the DC transfer mode.

Therefore, by lowering the toner charge before secondary transfer in the superimposed transfer mode compared to the toner charge before secondary transfer in the DC transfer mode, the electrostatic adhesion between toner and between the toner and the intermediate transfer member is smaller. The waveform of the secondary transfer bias is the same as EMBODIMENT 1, and as shown in FIG. 9, the absolute value of the secondary transfer bias may be made smaller. As a result, the AC voltage Vpp shown in FIG. 9(*b*), may be made smaller compared to a conventional example shown in Table 7 described hereinafter. Accordingly, image degradation such as discharge images does not occur in the superimposed transfer mode, and good transferability in either the DC transfer mode or the superimposed transfer mode is attained. The reduction ratio of the absolute value of the toner charge before secondary transfer in the superimposed transfer mode to the DC transfer mode is preferably equal to or above 5%.

Embodiment 3

Figure 10:
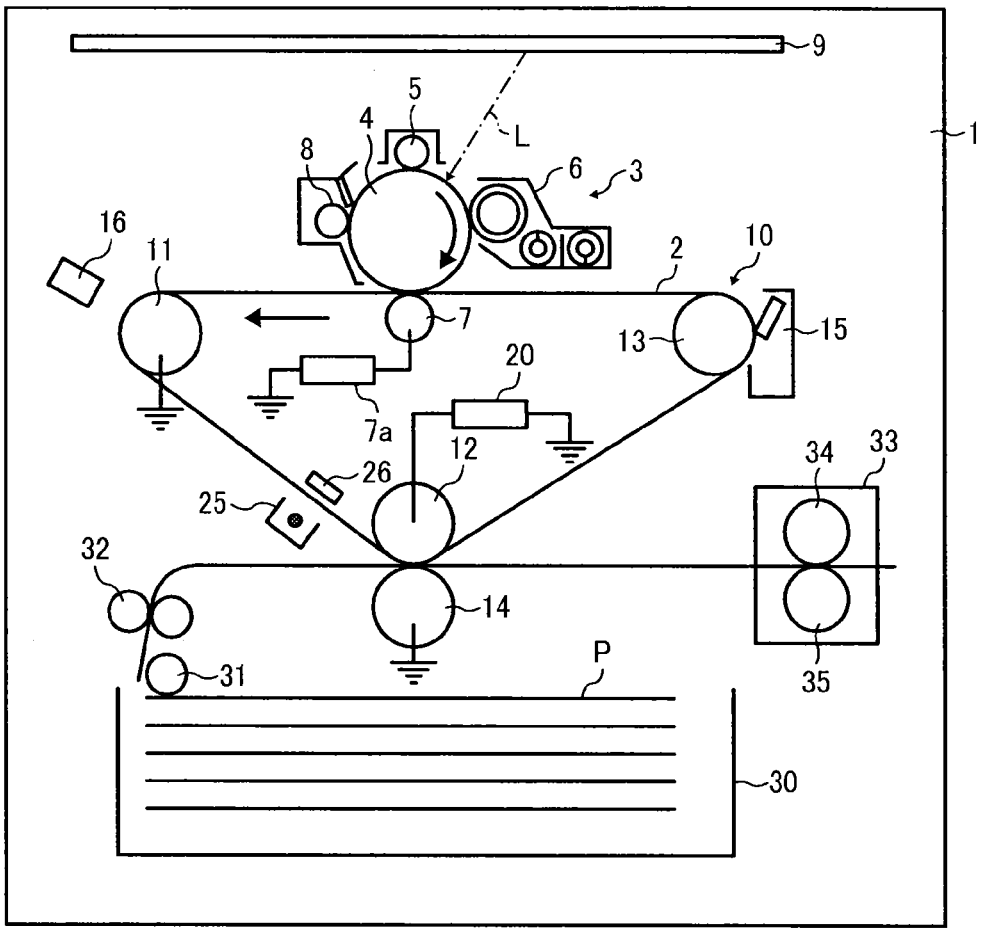
FIG. 10 is a cross-sectional diagram of an image forming apparatus of EMBODIMENT 3.

EMBODIMENT 3 is an image forming apparatus with the structure described in EMBODIMENT 1 but with a charging device and a counter electrode before the secondary transfer member, employing a method that changes the toner charge before secondary transfer. The structure is shown in FIG. 10. It is to be noted, that other than a charging device 25 before the secondary transfer, the structure of the image forming apparatus, the employed materials, and the reference numerals are the same as EMBODIMENT 1.

In the present EMBODIMENT 3, the charging device 25 before the secondary transfer employs a non-contact corotron method and controls the wire voltage so that it is applied in the superimposed transfer mode. The reference numeral 26 is the counter electrode to the charging device 25.

TABLE 4

| | Primary transfer current (μA) | Charge voltage before secondary transfer (V) | Toner charge before secondary transfer (μC/g) | Secondary transfer current (μA) | Secondary transfer voltage (kVpp) |
|---|---|---|---|---|---|
| DC transfer mode | 33 | 0 | −32 | −40 | — |
| Superimposed transfer mode | 33 | 500 | −30 | −32 | 8 |

Table 4 illustrates the settings and the toner charge before secondary transfer in EMBODIMENT 3. A primary transfer current in both the DC transfer mode and the superimposed transfer mode is 33 μA. A 500V charge is applied to the charging device in the superimposed transfer mode and changes the toner charge before secondary transfer. As a result, the toner charge before the secondary transfer in the DC transfer mode is −32 μC/g. By contrast, the toner charge before the secondary transfer in the superimposed transfer mode is −30 μC/g and has a smaller absolute value. Accordingly, the electrostatic adhesion between toner and between the toner and the intermediate transfer member is smaller. As a result, as seen in EMBODIMENT 1, the AC voltage (Vpp shown in FIG. 9(*b*)) in the superimposed transfer mode may be made smaller compared to a conventional example shown in Table 7 described hereinafter. Accordingly, image degradation such as discharge images does not occur in the superimposed transfer mode, and good transferability in either the DC transfer mode or the superimposed transfer mode is attained.

It is to be noted that the charging device of EMBODIMENT 3 and the voltage applied to the charging device are one example of an image forming apparatus according to the present disclosure, and are not limited thereto.

Embodiment 4

EMBODIMENT 4 is an image forming apparatus with the structure described in EMBODIMENT 1, employing a method in which a time-averaged value (Vave) of the AC voltage in the superimposed transfer mode is set to a polarity in a direction of transfer of toner from the intermediate transfer member onto the recording medium, and is closer to the transfer direction side than is a midpoint value (Voff) intermediate between a maximum value of the AC voltage and a minimum value of the AC voltage.

Figure 11:
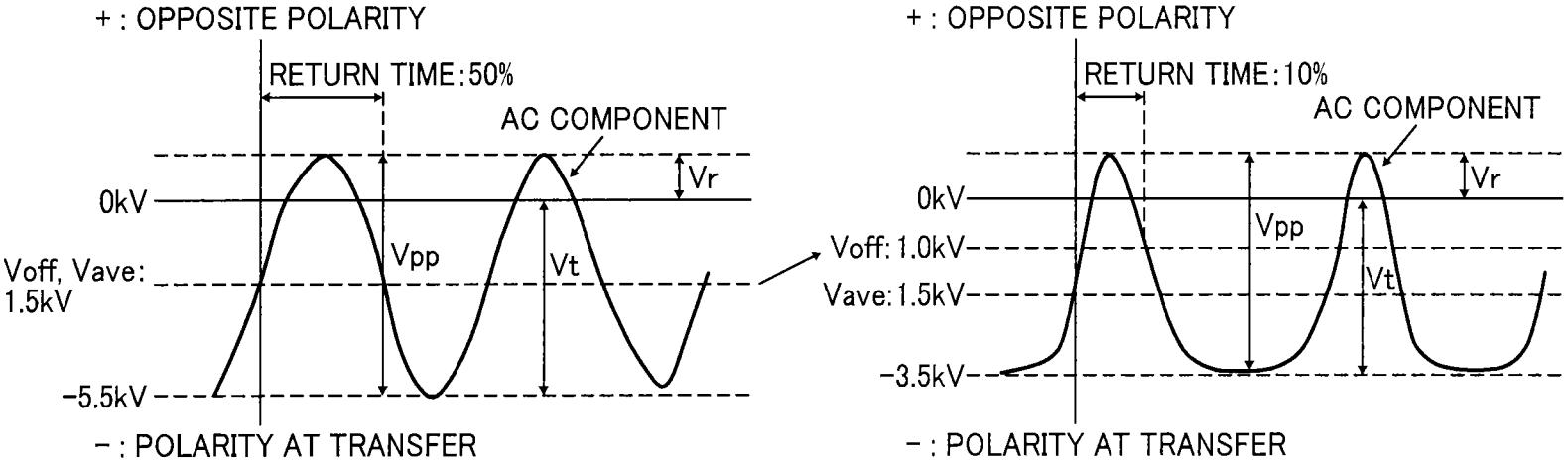
FIG. 11 is a waveform diagram illustrating the waveforms of the secondary transfer bias of EMBODIMENT 1 and EMBODIMENT 4.

FIG. 11(*b*) illustrates a waveform of the secondary transfer bias of EMBODIMENT 4. Return time (the proportion of the toner return side (opposite to the direction of transfer) beyond the midpoint value (Voff) intermediate between the maximum value of the AC voltage and the minimum value of the AC voltage) is set at approximately 10%. For return time, approximately 4% to 45% is preferable. FIG. 11(*a*) illustrates the waveform (sinusoidal waveform) of the secondary transfer bias of EMBODIMENT 1 and corresponds to a return time of 50%. As a result, the time-averaged value (Vave) of the AC voltage is set to a polarity in a direction of transfer of toner from the intermediate transfer member onto the recording medium, and is closer to the transfer direction side than is the midpoint value (Voff) of the maximum value of the AC voltage and the minimum value of the AC voltage.

In the image forming apparatus of the present disclosure, a waveform with rounded corners is used as an AC waveform. Alternatively, the waveform may be a triangular wave or a rectangular wave like that shown in FIG. 7.

TABLE 5

| | Primary transfer current (μA) | Toner charge before secondary transfer (μC/g) | Secondary transfer current (μA) | Secondary transfer voltage (kVpp) |
|---|---|---|---|---|
| DC transfer mode | 33 | −32 | −40 | — |
| Superimposed transfer mode | 30.5 | −30 | −30 | 6 |

Table 5 illustrates the settings and the toner charge before secondary transfer in EMBODIMENT 4. The DC transfer mode is the same as EMBODIMENT 1. The primary transfer current in the superimposed transfer mode, as seen in EMBODIMENT 1, is 30.5 μA and the toner charge before secondary transfer is −30 μC/g. From the difference in AC waveform, the secondary transfer current is −30 μA and the AC voltage is 6 kVpp and may be set smaller compared to EMBODIMENT 1 or a conventional example shown in Table 7 described hereinafter. Accordingly, image degradation such as discharge images does not occur in the superimposed transfer mode, and good transferability in either the DC transfer mode or the superimposed transfer mode is attained.

Embodiment 5

Figure 12:
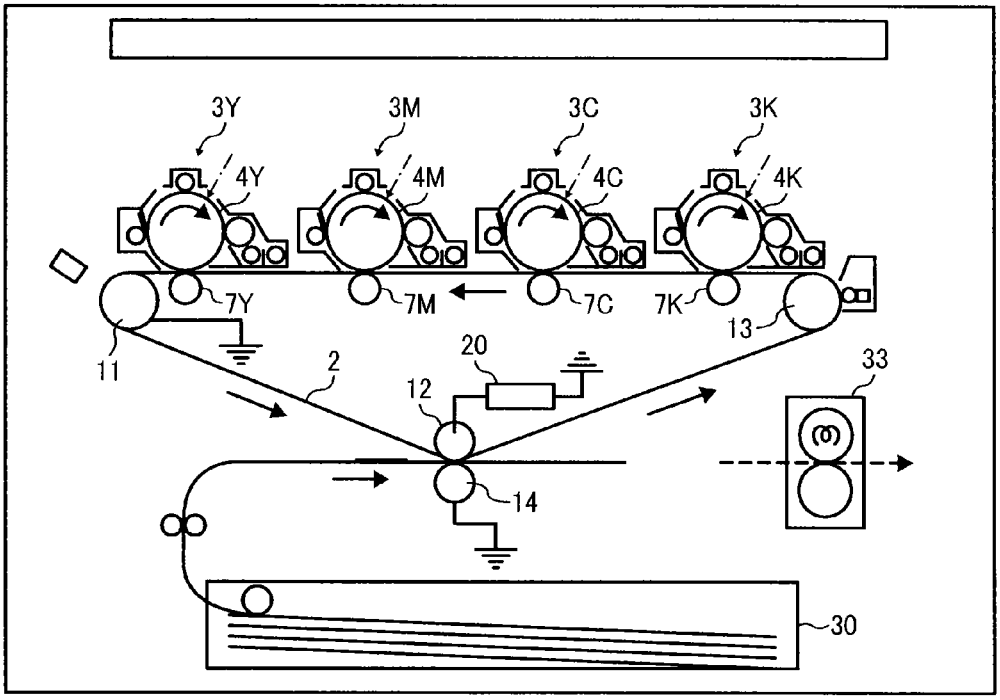
FIG. 12 is a cross-sectional diagram of a color image forming apparatus of EMBODIMENT 5.

EMBODIMENT 5 has a different structure compared to the structure of the image forming apparatus of EMBODIMENT 1. As shown in FIG. 12, it is a color image forming apparatus including image forming units 3Y, 3M, 3C, and 3K disposed in parallel for forming toner images of yellow (Y), magenta (M), cyan (C), and black (K) color, respectively. Also included is a tandem image creation member. Other than the image forming units 3Y, 3M, 3C, and 3K, the structure of the image forming apparatus is the same as EMBODIMENT 1. The employed reference numerals are the same with respect to identical members.

In EMBODIMENT 5, a toner image is formed by each of the image forming units 3Y, 3M, 3C, and 3K. A primary transfer bias is applied to each of primary transfer rollers 7Y, 7M, 7C, and 7K of each of the image forming units 3Y, 3M, 3C, and 3K by a transfer bias power source not shown in FIG. 12. Accordingly, a transfer electric field is formed between each of the primary transfer rollers 7Y, 7M, 7C, and 7K and each color toner image on each of photoreceptor drums 4Y, 4M, 4C, and 4K. Each color toner image is primarily transferred onto the intermediate transfer belt 2 from each of the photoreceptor drums 4Y, 4M, 4C, and 4K by the transfer electric field and a nip pressure. A composite toner image of four colors superimposed on each other is formed on the intermediate transfer belt 2 by sequentially superimposing primary transfers of Y-, M-, C-, and K-toner images.

TABLE 6

| | | Primary transfer current (μA) | Toner charge before secondary transfer (μC/g) |
|---|---|---|---|
| K | DC transfer mode | 33 | −32 |
| | Superimposed transfer mode | 30.5 | −30 |
| C | DC transfer mode | 34 | −58 |
| | Superimposed transfer mode | 31 | −56 |
| M | DC transfer mode | 36 | −57 |
| | Superimposed transfer mode | 31.5 | −55 |
| Y | DC transfer mode | 38 | −45 |
| | Superimposed transfer mode | 32 | −43 |

| | Secondary transfer current (μA) | Secondary transfer voltage (kVpp) |
|---|---|---|
| DC transfer mode | −70 | — |
| Superimposed transfer mode | −56 | 8 |

Table 6 illustrates the settings and the toner charge before secondary transfer in the full color mode of EMBODIMENT 5. The primary transfer current in the superimposed transfer mode of each color is set smaller than in the DC transfer mode. Accordingly, the absolute value of the toner charge before secondary transfer is smaller in the superimposed transfer mode of each color. Thus, the electrostatic adhesion between toner and between the toner and the intermediate transfer member is smaller. As a result, the absolute value of the secondary transfer current in the superimposed transfer mode may also be made smaller than in the DC transfer mode (Voff). Accordingly, the AC voltage (Vpp) may be made smaller than a conventional example shown in Table 7 described hereinafter. Thus, image degradation such as discharge images does not occur in the superimposed transfer mode, and good transferability in either the DC transfer mode or the superimposed transfer mode is attained.

In order to facilitate an understanding of the novel features of the illustrative embodiments, as a comparison a description is provided of a conventional example with reference to Table 7.

The conventional example has a structure of the image forming apparatus of EMBODIMENT 1 with the same settings of the primary transfer current in the DC transfer mode and in the superimposed transfer mode.

TABLE 7

| | Primary transfer current (μA) | Toner charge before secondary transfer (μC/g) | Secondary transfer current (μA) | Secondary transfer voltage (kVpp) |
|---|---|---|---|---|
| DC transfer mode | 33 | −32 | −40 | — |
| Superimposed transfer mode | 33 | −32 | −40 | 9 |

Figure 13:
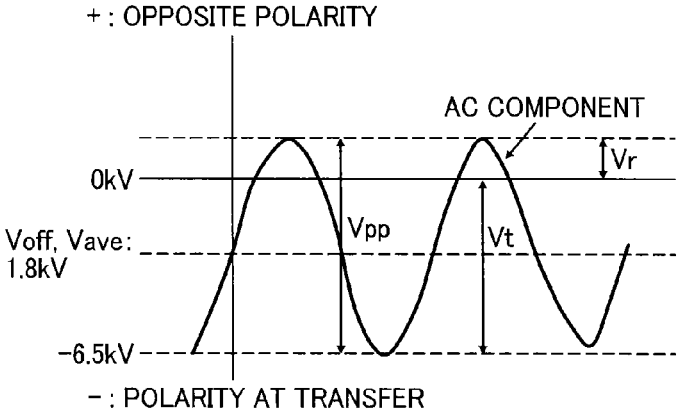
FIG. 13 is a waveform diagram illustrating the waveform of a secondary transfer bias in a conventional example.

Table 7 illustrates the settings and the toner charge before secondary transfer of the conventional example. A waveform of the secondary transfer bias with the conditions of Table 7 is shown in FIG. 13.

In the conventional example, the primary transfer current in the DC transfer mode and in the superimposed transfer mode is the same. Accordingly, the toner charge before secondary transfer is the same. As a result, the secondary transfer current in the DC transfer mode and in the superimposed transfer mode also needs to be the same, leading to setting the secondary transfer voltage (Vpp) much larger than in EMBODIMENT 1.

The present inventors performed an experiment with the settings and structure of EMBODIMENTS 1 to 4 and the conventional example, in which a recording medium was processed in a superimposed transfer mode.

Environment: Temperature 23° C., Humidity 50%

Recording medium: Special paper LEATHAC 66, Ream weight: 130 kg

Image: Black, full-page solid image, single side feed through

Mode: Superimposed transfer mode

Evaluation items: Transferability to recessed portions, Transferability to projecting portions, Discharge images

TABLE 8

| | Transferability to recessed portions | Transferability to projecting portions | Discharge images |
|---|---|---|---|
| Conventional example | Good | Good | Poor |
| EMBODIMENT 1 | Good | Fair | Good |
| EMBODIMENT 2 | Good | Good | Good |
| EMBODIMENT 3 | Good | Good | Good |
| EMBODIMENT 4 | Very Good | Good | Good |

The evaluation results are shown in Table 8. The evaluation scale in Table 8 is as follows.

Poor=Marked image degradation

Fair=A little image degradation is seen (acceptable level)

Good=No image degradation

Very Good=No image degradation and superior to Good

In the conventional example, the generation of discharge images occurred due to high AC voltage. In EMBODIMENTS 1 to 4, the generation of discharge images was not seen, exhibiting an advantage of the present disclosure.

In a configuration as in EMBODIMENT 1, the transferability of toner to the projecting portions is a little lower compared to the conventional example though is at an acceptable level. Due to having no generation of discharge images, overall the configuration of EMBODIMENT 1 is advantageous compared to the conventional example. In a configuration as in EMBODIMENT 4, the transferability to the projecting portions is particularly enhanced by changing the waveform of the AC component. From the results, it is clear that by making the absolute value of the DC component of the secondary transfer bias in the superimposed transfer mode smaller than the DC component of the secondary transfer bias in the DC transfer mode, generation of discharge images is prevented. Also, by adjusting the toner charge before secondary transfer, the generation of discharge images is prevented and an advantageous effect to transferability to recessed portions and transferability to projecting portions can be observed. Furthermore, by changing the AC component waveform, an advantageous effect to transferability to recessed portions can be observed.

Figure 14:
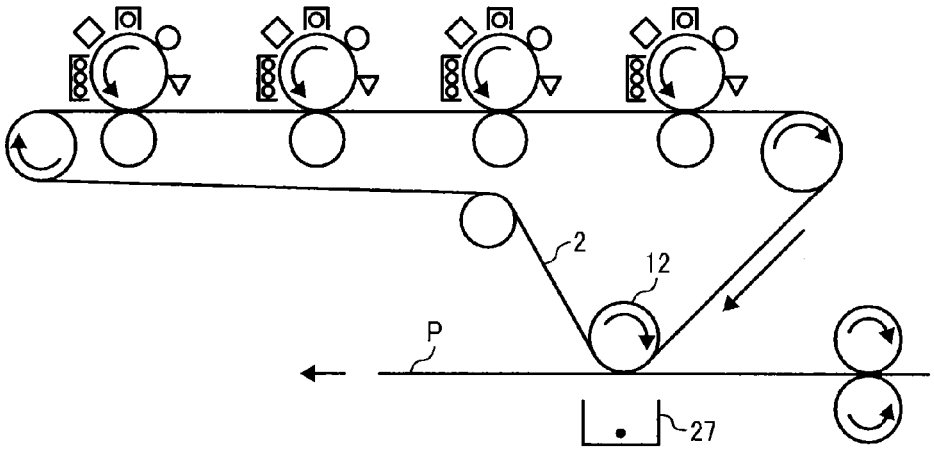
FIG. 14 is a schematic diagram illustrating a secondary transfer member according to another illustrative embodiment.
Figure 15:
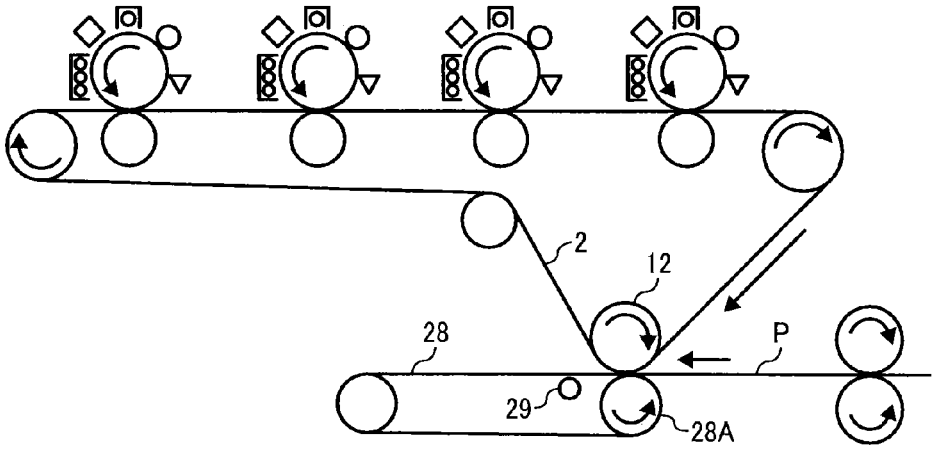
FIG. 15 is a schematic diagram illustrating a secondary transfer member according to still another illustrative embodiment.

Although the present disclosure has been described with respect to a specific embodiment for a complete and clear disclosure, the structure and settings are not to be thus limited but are to be construed as embodying all modifications and alternative constructions that may occur to one skilled in the art that fairly fall within the basic teachings herein set forth. The structure of the transfer device is arbitrary and the opposite device may be a belt structure. Also, as a transfer method, it is not limited to a method of forming a nip. A non-contact method employing a charger 27 as shown in FIG. 14 or a method employing a secondary transfer belt 28 as shown in FIG. 15 may be employed. When using the secondary transfer belt 28, the application of voltage may be done by a tension roller 28A that holds taut the secondary transfer belt 28 or by a secondary transfer back surface roller opposite the tension roller 28A. Alternatively, the voltage may be applied by a bias application roller 29, different from the tension roller 28A. The bias application roller 29 may be disposed opposite the secondary transfer back surface roller or disposed upstream or downstream the sheet passage.

Figure 16:
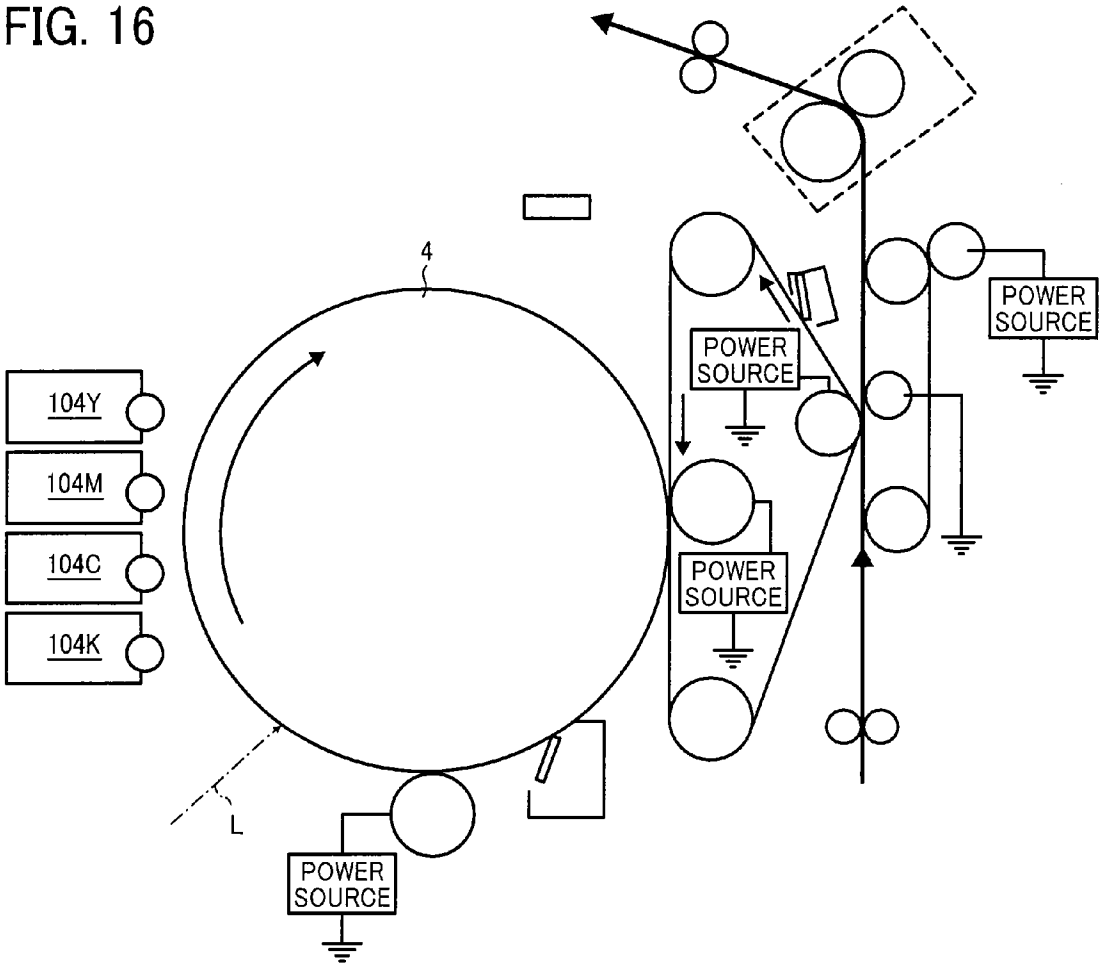
FIG. 16 is a schematic diagram illustrating an image forming apparatus according to still another illustrative embodiment.

The structure of the power source is arbitrary and may be a structure that fairly falls within the basic teachings herein set forth. Also, the structure of the image forming device is arbitrary. In a tandem type configuration, the order of image forming units is not limited to the configuration shown in the drawings. The foregoing descriptions pertain to an image forming apparatus using four colors of toners. The image forming apparatus includes, but is not limited to, a full-color image forming apparatus employing two or more colors of toners and a so-called single drum type image forming apparatus with one photoreceptor 4 such as shown in FIG. 16. Furthermore, the image forming apparatus includes, but is not limited to, an electrophotographic image forming apparatus, a copier, a printer, a facsimile machine, and a multi-functional system including at least two of these functions thereof.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

What is claimed is:

1. An image forming apparatus, comprising:

a photoreceptor to bear an electrostatic latent image on a surface thereof;

a developing device to develop the electrostatic latent image into a toner image;

an intermediate transfer member onto which the toner image is transferred;

a primary transfer member to apply a primary transfer bias to the intermediate transfer member to transfer the toner image thereto;

a secondary transfer member supplied with a secondary transfer bias, to transfer the toner image from the intermediate transfer member onto a recording medium; and a transfer bias power source to selectively apply to the secondary transfer member one of a secondary transfer bias consisting of a direct current (DC) voltage in a DC transfer mode and a secondary transfer bias consisting of a superimposed bias in which an alternating current (AC) voltage is superimposed on a DC voltage and having a waveform in which a polarity alternates between a transfer polarity for transferring the toner image onto the recording medium and a polarity opposite the transfer polarity in a superimposed transfer mode, wherein an absolute value of a DC component of the secondary transfer bias in the superimposed transfer mode is smaller than an absolute value of a DC component of the secondary transfer bias in the DC transfer mode under same environmental conditions, using same recording media, and transferring same toner images.

2. The image forming apparatus according to claim 1, wherein an absolute value of a toner charge of the toner image before secondary transfer of the toner image in the superimposed transfer mode is smaller than a toner charge of the toner image before secondary transfer of the toner image in the DC transfer mode under same environmental conditions, using same recording media, and transferring same toner images.

3. The image forming apparatus according to claim 1, wherein an absolute value of the primary transfer bias is smaller in the superimposed transfer mode than the DC transfer mode to make an absolute value of a toner charge of the toner image before secondary transfer of the toner image in the superimposed transfer mode smaller than a toner charge of the toner image before secondary transfer of the toner image in the DC transfer mode.

4. The image forming apparatus according to claim 1, further comprising a charging device disposed before the secondary transfer member, wherein the charging device is charged before secondary transfer of the toner image in the superimposed transfer mode to a voltage sufficient to make an absolute value of a toner charge of the toner image before secondary transfer of the toner image in the superimposed transfer mode smaller than a toner charge of the toner image before secondary transfer of the toner image in the DC transfer mode.

5. The image forming apparatus according to claim 1, wherein the AC voltage has a sinusoidal waveform.

6. The image forming apparatus according to claim 1, wherein a time-averaged value (Vave) of the AC voltage in the superimposed transfer mode has an absolute value greater than an absolute value of a midpoint value (Voff) between a maximum value and a minimum value of the AC voltage.

7. The image forming apparatus according to claim 1, wherein the DC voltage is subjected to constant current control.

8. The image forming apparatus according to claim 1, comprising a plurality of photoreceptors.

9. The image forming apparatus according to claim 1, wherein a polarity of the primary transfer bias is the opposite of the transfer polarity of the secondary transfer bias.

10. A method performed by an image forming apparatus, comprising:

developing an electrostatic latent image formed on a photoreceptor into a toner image;

transferring the toner image onto an intermediate transfer member;

applying a primary transfer bias to the intermediate transfer member to transfer the toner image thereto;

supplying a secondary transfer bias to a secondary transfer member, to transfer the toner image from the intermediate transfer member onto a recording medium; and selectively applying to the secondary transfer member one of a secondary transfer bias consisting of a direct current (DC) voltage in a DC transfer mode and a secondary transfer bias consisting of a superimposed bias in which an alternating current (AC) voltage is superimposed on a DC voltage and having a waveform in which a polarity alternates between a transfer polarity for transferring the toner image onto the recording medium and a polarity opposite the transfer polarity in a superimposed transfer mode, wherein an absolute value of a DC component of the secondary transfer bias in the superimposed transfer mode is smaller than an absolute value of a DC component of the secondary transfer bias in the DC transfer mode under same environmental conditions, using same recording media, and transferring same toner images.

11. A non-transitory computer-readable storage medium storing computer-readable instructions thereon, which, when executed by an image forming apparatus, cause the image forming apparatus to perform a method comprising:

developing an electrostatic latent image formed on a photoreceptor into a toner image;

transferring the toner image onto an intermediate transfer member;

applying a primary transfer bias to the intermediate transfer member to transfer the toner image thereto;

supplying a secondary transfer bias to a secondary transfer member, to transfer the toner image from the intermediate transfer member onto a recording medium; and selectively applying to the secondary transfer member one of a secondary transfer bias consisting of a direct current (DC) voltage in a DC transfer mode and a secondary transfer bias consisting of a superimposed bias in which an alternating current (AC) voltage is superimposed on a DC voltage and having a waveform in which a polarity alternates between a transfer polarity for transferring the toner image onto the recording medium and a polarity opposite the transfer polarity in a superimposed transfer mode, wherein an absolute value of a DC component of the secondary transfer bias in the superimposed transfer mode is smaller than an absolute value of a DC component of the secondary transfer bias in the DC transfer mode under same environmental conditions, using same recording media, and transferring same toner images.

12. An image forming apparatus, comprising:

an image bearer to bear a toner image;

a transfer member to form a transfer nip between the transfer member and the image bearer; and a power source to selectively output one of a DC bias consisting of a DC voltage in a DC transfer mode and a superimposed bias in which an AC voltage is superimposed on a DC voltage in a superimposed transfer mode to transfer the toner image to a recording medium in the transfer nip, wherein an absolute value of the DC voltage in the superimposed transfer mode is smaller than an absolute value of the DC voltage in the DC transfer mode under same environmental conditions, using same recording media, and transferring same toner images.

13. The image forming apparatus according to claim 12, wherein an absolute value of a set value of a DC transfer current in the superimposed transfer mode is smaller than an absolute value of a set value of a DC transfer current in the DC transfer mode under same environmental conditions, using same recording media, and transferring same toner images.

14. The image forming apparatus according to claim 12, wherein an absolute value of a set value of a DC transfer voltage in the superimposed transfer mode is smaller than an absolute value of a set value of a DC transfer voltage in the DC transfer mode under same environmental conditions, using same recording media, and transferring same toner images.

15. The image forming apparatus according to claim 12, wherein the image bearer is an intermediate transfer member.

16. The image forming apparatus according to claim 1, further comprising a sheet cassette and a fixing device, wherein the toner image is transferred, after the recording medium is fed from the sheet cassette and before the recording medium enters the fixing device, onto the recording medium.

17. The image forming apparatus according to claim 12, further comprising a sheet cassette and a fixing device, wherein the toner image is transferred, after the recording medium is fed from the sheet cassette and before the recording medium enters the fixing device, onto the recording medium.

18. The image forming apparatus according to claim 1, wherein a polarity of the DC component of the secondary transfer bias in the superimposed transfer mode and a polarity of the DC component of the secondary transfer bias in the DC transfer mode are the same.

19. The image forming apparatus according to claim 12, wherein a polarity of the DC voltage in the superimposed transfer mode and a polarity of the DC voltage in the DC transfer mode are the same.

20. An image forming apparatus, comprising:

a photoreceptor on which a toner image is formed;

an image bearer to bear the toner image;

a primary transfer bias power source to output a primary transfer bias to transfer the toner image from the photoreceptor to the image bearer;

a secondary power source to output a secondary transfer bias to transfer the toner image from the image bearer onto a recording medium; and a controller to switch a mode between a first mode and a second mode, wherein an absolute value of a toner charge of the toner image before secondary transfer of the toner image to the recording medium is set to a first value in the first mode, and the absolute value of the toner charge of the toner image before secondary transfer of the toner image to the recording medium is set to a second value larger than the first value in the second mode.

21. The image forming apparatus according to claim 20, further comprising:

wherein the controller controls the absolute value of the toner charge of the toner image by controlling the primary transfer bias.

22. The image forming apparatus according to claim 21, wherein the controller controls the absolute value of the toner charge of the toner image by controlling an intensity of the primary transfer bias.

23. The image forming apparatus according to claim 21, wherein the primary transfer bias consists of a DC component.

24. The image forming apparatus according to claim 23, wherein the DC component is controlled under a constant current control.

25. The image forming apparatus according to claim 20, wherein the controller switches the mode according to a type of the recording medium.

26. The image forming apparatus according to claim 20, wherein the secondary power source outputs a superimposed bias in which an AC component is superimposed on a DC component in the first mode, and the secondary power source outputs a DC bias consisting of a DC component in the second mode.

27. The image forming apparatus according to claim 26, wherein the controller switches the mode according to a type of the recording medium.

28. The image forming apparatus according to claim 26, wherein the controller selects the first mode when the toner image is transferred to the recording medium with a coarse surface, and selects the second mode when the toner image is transferred to the recording medium with a smooth surface smoother than the coarse surface.

29. The image forming apparatus according to claim 20, wherein the controller selects the first mode or the second mode in response to a user input via a device.

* * * * *